US005897150A

United States Patent [19]

Rubini

[11] Patent Number: 5,897,150

[45] Date of Patent: Apr. 27, 1999

[54] SUPPORTING AND RAISING DEVICE FOR SUPPORTING AND RAISING PLASTIC BOTTLES

[76] Inventor: Luciano Rubini, Via Lazzaretto, 29, 26020 Agnadello (Cremona), Italy

[21] Appl. No.: 09/049,590

[22] Filed: Mar. 27, 1998

[30] Foreign Application Priority Data

Apr. 4, 1997 [IT] Italy ..... MI970239 U

[51] Int. Cl.[6] ..... B65D 23/10

[52] U.S. Cl. ..... 294/27.1; 294/31.2; 215/396

[58] Field of Search ..... 294/27.1, 30, 31.1, 294/31.2, 145, 137, 92; 215/396; 16/114 R; 220/752, 759

[56] References Cited

U.S. PATENT DOCUMENTS

| | | | |
|---|---|---|---|
| 2,406,696 | 8/1946 | Leslie | 294/27.1 |
| 3,021,026 | 2/1962 | Clare | 294/27.1 |
| 3,520,570 | 7/1970 | Christopher et al. | 294/27.1 |
| 3,610,671 | 10/1971 | Conger | 215/396 |
| 4,667,359 | 5/1987 | Polotti | 294/31.2 |
| 4,773,549 | 9/1988 | Avraham | 215/396 |
| 4,936,614 | 6/1990 | Russell | 294/27.1 |
| 5,335,954 | 8/1994 | Holub et al. | 294/31.2 |

FOREIGN PATENT DOCUMENTS

| | | | |
|---|---|---|---|
| 83/02101 | 6/1983 | WIPO | 294/27.1 |

*Primary Examiner*—Dean Kramer
*Attorney, Agent, or Firm*—Hedman, Gibson & Costigan, P.C.

[57] ABSTRACT

A plastic bottle, having a supporting and raising device including a handle, provided with a contoured casing allowing the device to be pressure engaged on a collar element of a plastic bottle. The handle has a first semicircular cross-section handle portion and a second rectangular cross-section handle portion, while the contoured casing has a rectangular cross-section casing portion having an outer flat region thereon is arranged a reinforcement element contacting a rim of a semicircular recess communicating with a horse shoe shaped recess slanted with respect to the semicircular recess.

3 Claims, 3 Drawing Sheets

SUPPORTING AND RAISING DEVICE FOR SUPPORTING AND RAISING PLASTIC BOTTLES

BACKGROUND OF THE INVENTION

The present invention relates to a supporting and raising device specifically designed for supporting and raising plastic bottles.

As is known, in raising and handling, after their opening, plastic bottles holding mineral water, drinks or liquids in general, care must be exerted in order not to spill the liquid contents thereof, in particular as this liquid is poured into a cup or the like.

In fact, a plastic bottle is susceptible to be easily deformed and the gripping by the user's hand is frequently sufficient to greatly deform the geometrical configuration of the bottle.

The above mentioned geometrical deformation in turn causes a decrease of the inner volume available for the liquid contents: this in turn causes the liquid to be poured with an excessive rate thereby the liquid can also spill-out of the cup into which it is poured.

Moreover, the gripping of a user's hand on said bottle is also susceptible to cause instability problems because of the mentioned deformability of the bottle: thus, the user must pay attention in holding a plastic bottle in his/her hand, as the bottle is opened.

SUMMARY OF THE INVENTION

Thus, in order to overcome the above mentioned problems, the invention provides a supporting and raising device, specifically designed for supporting and raising plastic bottles, which is of a general purpose nature, as a small size, can be easily made at a low making cost, and can be easily used by the user.

More specifically, according to the invention, a supporting and raising device for supporting and raising plastic bottles comprises a handle, in which is provided a contoured casing, or recess, allowing the device to be pressure engaged on the neck collar of the plastic bottles.

The supporting and raising device according to the present invention is characterized by the feature stated in claim 1.

The plastic bottle supporting and raising device according to the invention provides the following advantages.

The device according to the invention is of a general purpose type and can be fitted to any types of plastic bottles, owing to the fact that, in order to meet making requirements, the neck collar configuration of said bottles is always the same.

The size of the subject device is very small and, as it is not used, it can be easily stored in a drawer.

The subject device provides a firm and stable gripping of the plastic bottles and, moreover, the user must apply less effort for performing the liquid pouring operation.

In fact, owing to the specifically designed configuration of the subject device, the user's wrist will be slightly stressed during the liquid pouring operation.

Finally, the device according to the invention can be easily washed, either manually or in a dish washing machine, if it is soiled by liquid.

BRIEF DESCRIPTION OF THE DRAWINGS

Further characteristics and advantages of the plastic bottle supporting and raising device, according to the present invention, will become more apparent thereinafter from the following detailed disclosure, with reference to the accompanying drawings, where.

DESCRIPTION OF THE PREFERRED EMBODIMENT

Figure 1:
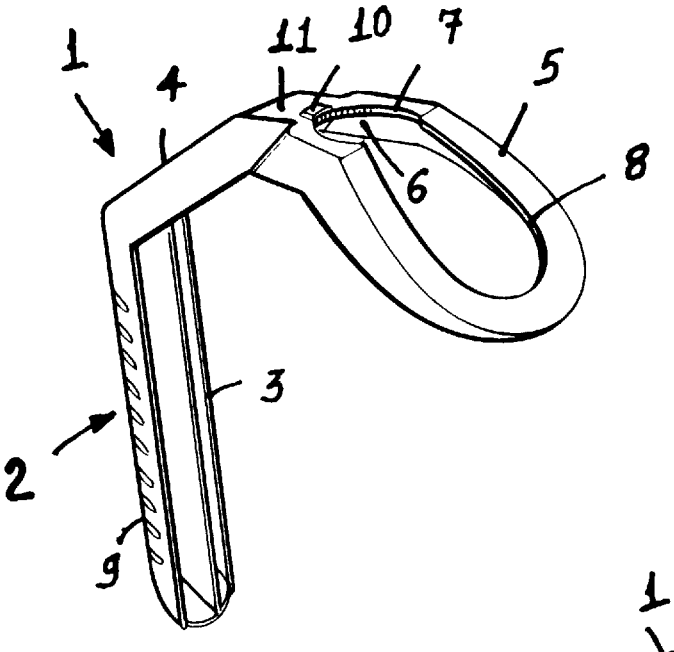
FIG. 1 is a perspective view of the device according to the invention.

With reference to the number references of the accompanying drawings, the plastic bottle supporting and raising device according to the invention, which has been generally indicated by the reference number 1, can be made of a plastic or metal material, and comprises a handle 2 having a first semicircular cross-section rectilinear portion 3 followed by a second rectangular cross-section portion 4, which is slanted with respect to the first portion.

The first portion 3 is provided, on the surface thereof, with a plurality of slots 9, affording an improved gripping.

In order to achieve the same gripping result, it would be possible to provide on the portion 3 a knurled surface, not shown in the figures.

The second portion 4 fixedly and permanently connects the handle 2 to a contoured casing 5.

Said contoured casing 5 comprises a first casing portion 11, also of rectangular cross-section, forming an obtuse angle with the second portion 4 of the handle 2, which on the outside thereof is provided with a flat region 12 in which a semicircular recess 6 is formed, the surface of said semicircular recess being advantageously covered by a rubber protective element 7, as the device 1 is made of a metal material. In fact, by this provision, the plastic bottle 13 will be protected against possible cuts.

The semicircular recess 6, finally, communicates with an access recess 8 having a horse shoe shape, allowing the plastic bottle 13 to be easily engaged in the contoured casing 5.

In order to facilitate the use of the device, the access recess 8 is slanted with respect to the plane defined by the mentioned semicircular recess 6.

A reinforcement element 10, made of the same material used for the device 1 is moreover provided on the flat region 12 in contact with the semicircular recess 6 rim.

In this connection it should be apparent that the materials used for making the device, as well as the contingent size and shapes thereof, can be any, depending on requirements.

Figure 2:
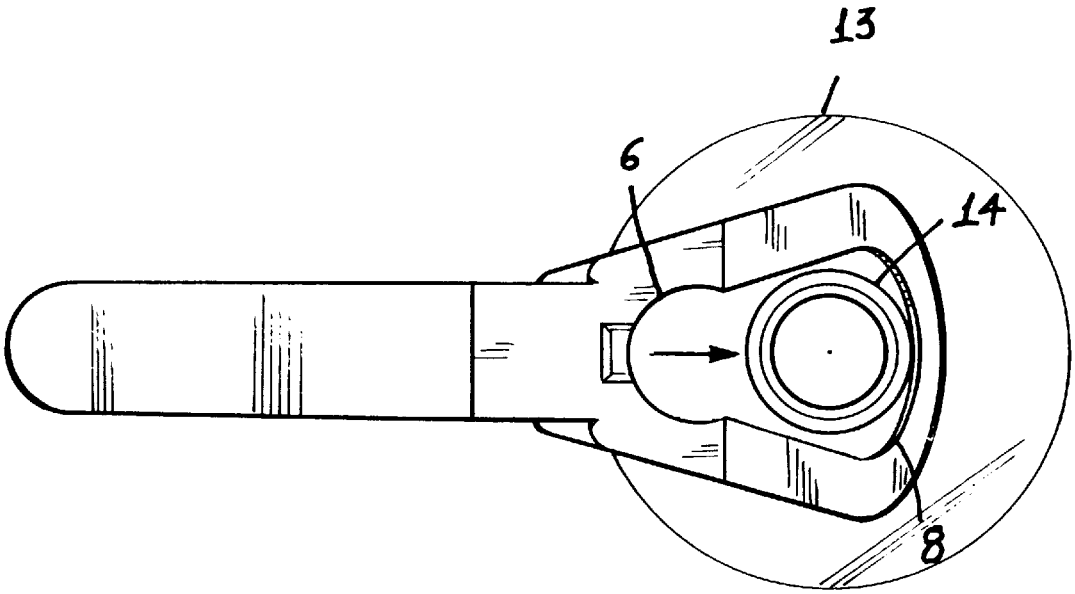
FIG. 2 illustrates two top plan views of the same device, respectively before and after the engagement thereby of a plastic bottle.
Figure 2:
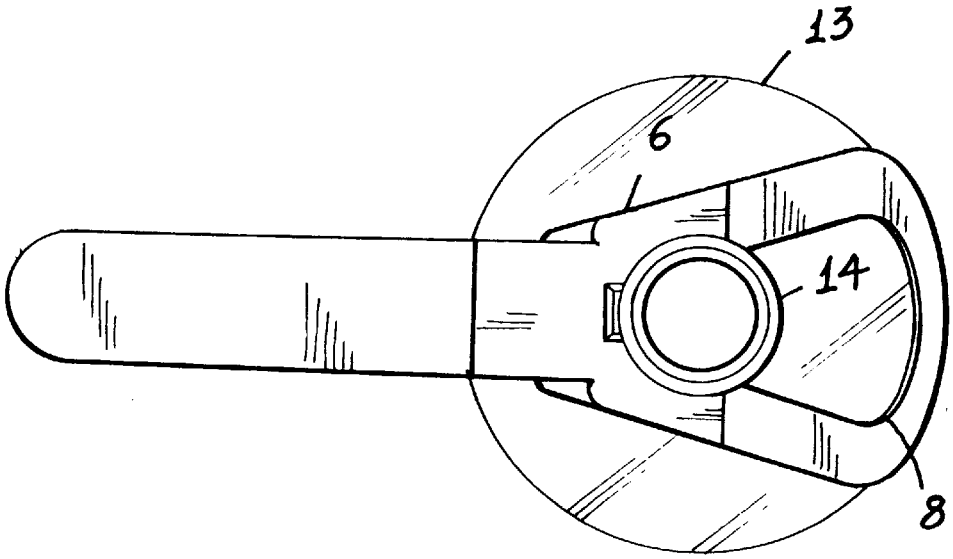
Figure 3:
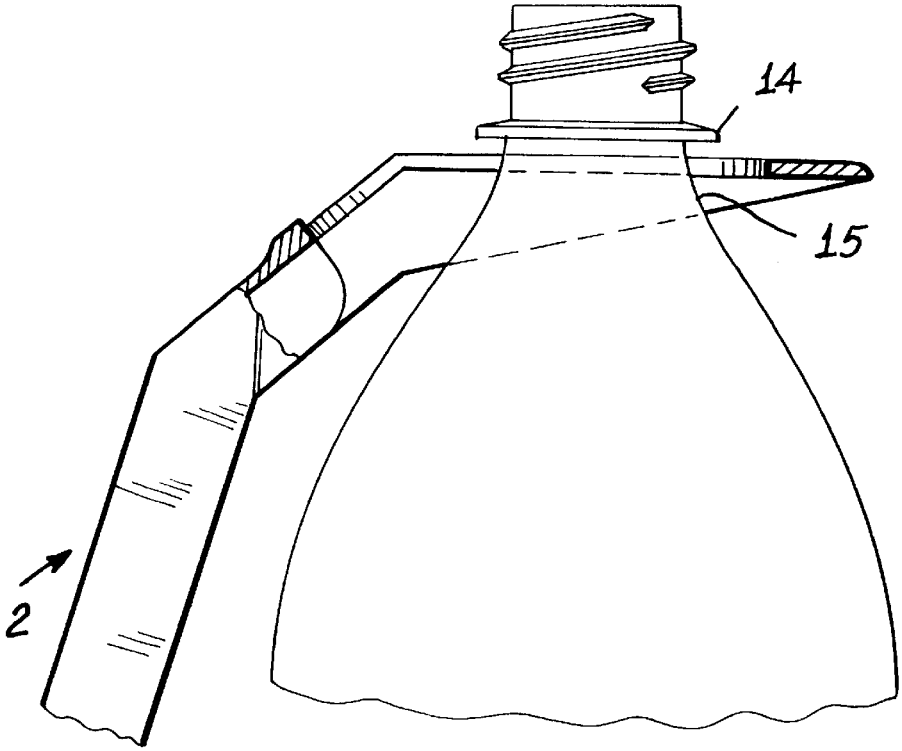
FIG. 3 illustrates two partially cross-sectioned perspective views of the device according to the invention, respectively before and after the engagement of a plastic bottle.
Figure 3:
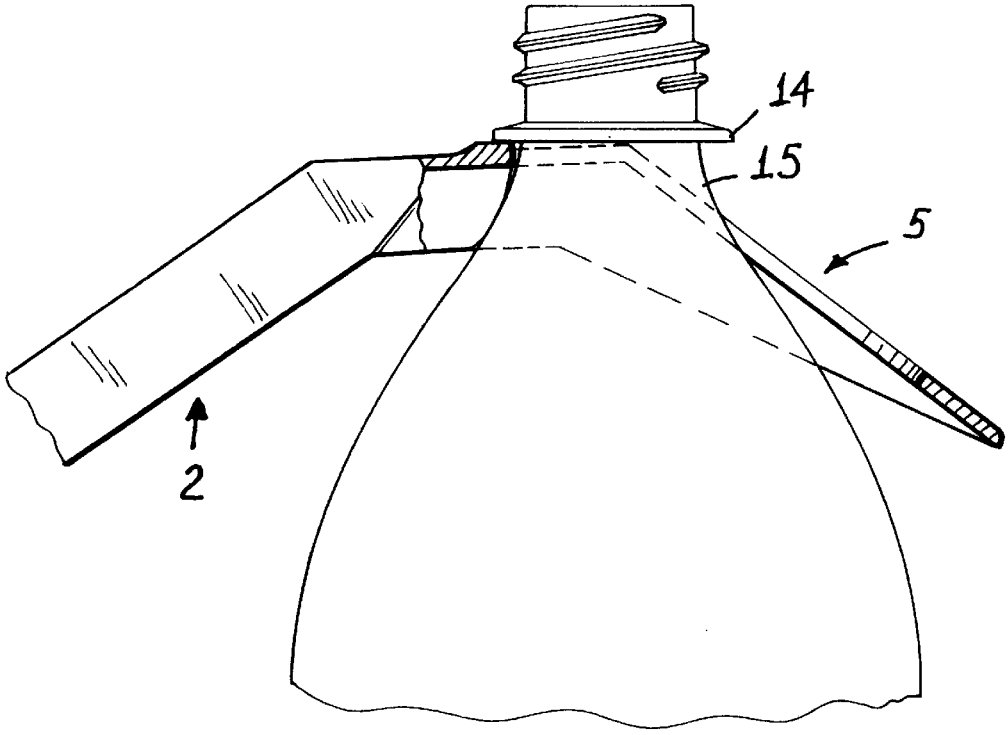

With reference to FIGS. 2 and 3, it should be apparent that the operation of the device 1 is very simple.

In fact, said device 1 exploits, for performing the engagement thereof, the plastic collar 14 provided on any plastic bottle 13, independently from the size and shape thereof, and this owing to the making method of said plastic bottles 13.

Thus, after having engaged the neck portion 15 of a plastic bottle 13 in the access recess 8 of the device 1, by simply translating said device 1, the plastic bottle 13 collar 14 is brought into contact with the semicircular recess 6, possibly covered by a rubber protective element 7.

Then, a small pressure will be sufficient to provide a firm connection between the device 1 and plastic bottle 13.

By using the device handle 2, the bottle can be handled in a precise and stable manner.

The specifically designed configuration of the inventive device 1, moreover, provides a very small stress on the user wrist, during the liquid pouring operation, because of the different type of movement required for said pouring operation.

Figure 4:
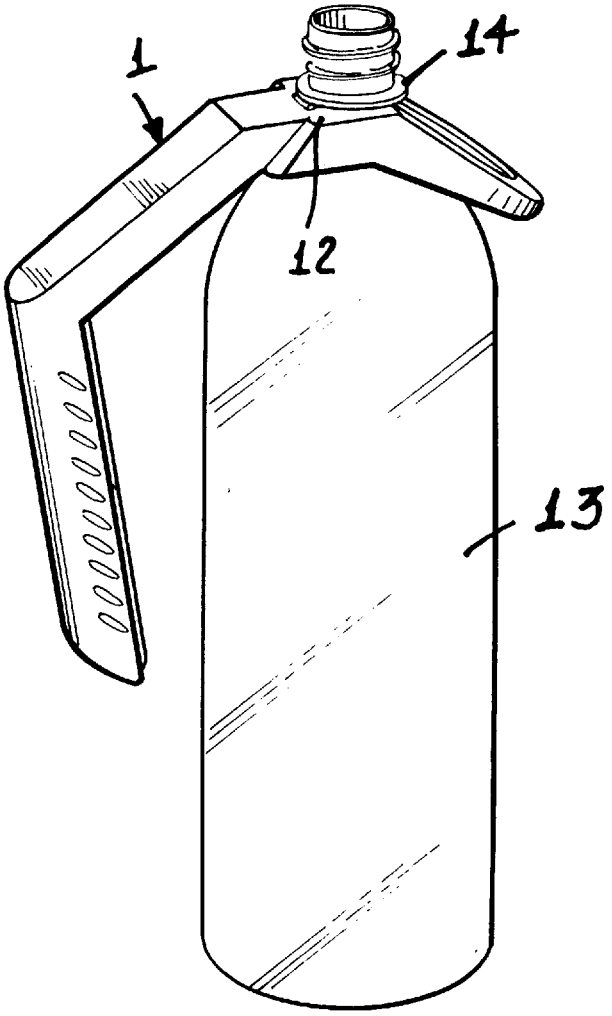
FIG. 4 is a perspective view of the subject device, engaged with a plastic bottle.

In this connection it should be also apparent that a very small liquid amount will be sufficient to provide stability to the bottle 13-device 1 assembly, as said assembly is arranged in a vertical position as shown in FIG. 4.

In fact, the system center of mass, provided that a small liquid amount is present, will fall inside the bearing base of the plastic bottle 13.

Said device 1 can be easily washed either manually or by a dish washing machine, since the materials forming said device have been specifically selected to resist against conventional washing temperatures and commercially available cleaning substances.

I claim:

1. A plastic bottle supporting and raising device comprises a handle (2) wherein said handle is coupled to a contoured casing (5) allowing the device to be pressure engaged on a collar (14) of a plastic bottle (13), wherein said contoured casing (5) comprises a rectangular cross-section casing portion (11) having an outer flat region (12), thereon is arranged a reinforcement element (10) contacting a rim of a semicircular recess (6) communicating with a horse shoe shaped access recess (8), said access recess being slanted with respect to a plane defined by said semicircular recess (6).

2. A plastic bottle supporting and raising device according to claim 1, wherein said semicircular recess is provided on a surface thereof with a rubber protective element.

3. A plastic bottle supporting and raising device comprises a handle wherein said handle is coupled to a contoured casing allowing the device to be pressure engaged on a collar of a plastic bottle, said handle comprising a first semicircular cross-section handle portion and a second rectangular cross-section handle portion, said first and second handle portions being slanted with respect to one another, wherein said contoured casing comprises a rectangular cross-section casing portion having an outer flat region, thereon is arranged a reinforcement element contacting a rim of a semicircular recess communicating with a horse shoe shaped access recess, said access recess being slanted with respect to a plane defined by said semicircular recess.

* * * * *